US011173086B2

(12) United States Patent
Huang

(10) Patent No.: US 11,173,086 B2
(45) Date of Patent: Nov. 16, 2021

(54) PLATE LIFTING DEVICE AND LIFTING BED HAVING THE SAME

(71) Applicant: TUNG KENG ENTERPRISE CO., LTD., Taichung (TW)

(72) Inventor: Chia-Yen Huang, Taichung (TW)

(73) Assignee: TUNG KENG ENTERPRISE CO., LTD., Taichung (TW)

( * ) Notice: Subject to any disclaimer, the term of this patent is extended or adjusted under 35 U.S.C. 154(b) by 767 days.

(21) Appl. No.: 16/007,302

(22) Filed: Jun. 13, 2018

(65) Prior Publication Data

US 2019/0380897 A1 Dec. 19, 2019

(51) Int. Cl.
*A47C 20/04* (2006.01)
*A61G 7/015* (2006.01)
*A61G 7/018* (2006.01)

(52) U.S. Cl.
CPC ..... *A61G 7/015* (2013.01); *A61G 7/018* (2013.01)

(58) Field of Classification Search
CPC ..... A47C 20/00; A47C 20/04; A47C 20/041
See application file for complete search history.

(56) References Cited

U.S. PATENT DOCUMENTS 3,048,366 A * 8/1962 Williamson ..... B62B 3/0618 254/5 C
3,250,569 A * 5/1966 Gaffney ..... A61G 5/14 297/330
3,503,082 A * 3/1970 Kerwit ..... A61G 7/015 5/601
4,715,073 A * 12/1987 Butler ..... A61G 7/005 5/509.1
5,294,179 A * 3/1994 Rudes ..... A61G 5/14 248/396

(Continued)

FOREIGN PATENT DOCUMENTS

TW M564445 U 8/2018

OTHER PUBLICATIONS

Examination Report for TW107115147, dated Nov. 14, 2018, Total of 9 pages.

(Continued)

*Primary Examiner* — Peter M. Cuomo
*Assistant Examiner* — Ifeolu A Adeboyejo
(74) *Attorney, Agent, or Firm* — R. Lynette Wylie; Apex Juris, PLLC.

(57) ABSTRACT

A plate lifting device capable of being applied to a multi-plate equipped apparatus includes a motor, a retractable shaft, a restriction member, and a lifting mechanism disposed on the base. The motor is disposed on a base of the multi-plate equipped apparatus. An end of the retractable shaft is pivotally disposed on the base and is connected to the motor, whereby to be driven by the motor to extend or retract, and another end thereof has a movable member. The restriction member connected to one of the plates of the multi-plate equipped apparatus has a slot capable of being passed through by the movable member. When the motor drives the retractable shaft to extend from an initial state, the movable member is lifted by the lifting mechanism, so that the restriction member and the plate connected to the restriction member, which are moved together with the movable member, are lifted.

10 Claims, 10 Drawing Sheets

(56) References Cited

U.S. PATENT DOCUMENTS

| | | | | |
|---|---|---|---|---|
| 5,404,604 | A * | 4/1995 | Has | A47C 20/041 5/617 |
| 6,101,648 | A * | 8/2000 | Sommerfeld | A61G 7/015 5/613 |
| 6,276,011 | B1 * | 8/2001 | Antinori | A47C 20/041 5/613 |
| 6,702,383 | B2 * | 3/2004 | Newman | A61G 5/14 297/313 |
| 7,036,165 | B2 * | 5/2006 | Weinman | A47C 20/041 5/617 |
| 7,325,265 | B2 * | 2/2008 | Hornbach | A61G 7/015 5/617 |
| 2012/0297543 | A1 * | 11/2012 | Robertson | A47C 20/041 5/616 |
| 2014/0237723 | A1 * | 8/2014 | Wysocki | A61G 7/015 5/613 |
| 2014/0352068 | A1 * | 12/2014 | Xu | A61G 7/015 5/616 |
| 2015/0007391 | A1 * | 1/2015 | Xu | A61G 7/018 5/616 |
| 2017/0128303 | A1 | 5/2017 | Hruschka et al. | |

OTHER PUBLICATIONS

Search Report for TW107115147, dated Nov. 14, 2018, Total of 1 page.
English Abstract for TWM564445, Total of 1 page.

* cited by examiner

PLATE LIFTING DEVICE AND LIFTING BED HAVING THE SAME

BACKGROUND OF THE INVENTION

Technical Field

The present invention relates generally to a plate lifting device and a lifting bed, and more particularly to a plate lifting device, which could smoothly lift a plate of a multi-plate equipped apparatus, and a lifting bed with the plate lifting device.

Description of Related Art

Electric lifting beds are commonly used in the medical or rehabilitation field, and its bed surface consists of a plurality of plates, wherein a lifting device is disposed below the plates to respectively lift the plates, whereby to support the user's back or legs, so that the user can change his posture easily. The lifting device has a retractable shaft and a driven member, which are arranged opposite to each other. For instance, the retractable shaft, which is adapted to lift the plate under the user's leg, is pivotally connected to a base of the lifting bed adjacent to the tail of the lifting bed, and the driven member is pivotally connected to the base of the lifting bed at a position below the user's hip when the user lies on the lifting bed. The retractable shaft is connected to a free end of the driven member. An end of the retractable shaft, which is pivotally connected to the base, is connected to a motor, wherein the motor could control the retractable shaft to extend or retract.

When the user wants to adjust a height of the lifting bed on which the user's lie his legs, the motor could be controlled by a controller to drive the retractable shaft to extend, and the extended retractable shaft pushes the driven member, so that the retractable shaft and the driven member rotate in a direction away from the base, and a junction between the retractable shaft and the driven member moves upward, whereby to push the plate, which is located above the retractable shaft and the driven member, to move. In this way, the plate on the tail of the lifting bed could be raised to support the user's legs.

If the tail of the lifting bed has already been raised, the retractable shaft and the driven member are deflected upwards, so that the vertical component of the force exerted by the motor which pushes the retractable shaft is larger. In such a condition, the tail of the lifting bed could be easily raised. However, if the lifting bed is in a horizontal state, the force exerted by the motor which pushes the retractable shaft is almost only the horizontal component. In such a condition, the lifting bed is hard to be lifted, and the push between the retractable shaft and the driven member during the lifting process may cause damage to the lifting device.

In addition, a multi-plate equipped apparatus that has similar functions with a lifting bed and uses a similar lifting device may also have such problems. Therefore, there is a need for the manufacturers to develop a new type of plate lifting device to solve the aforementioned problems.

BRIEF SUMMARY OF THE INVENTION

In view of the above, the primary objective of the present invention is to provide a plate lifting device, which could be applied to a multi-plate equipped apparatus and could smoothly lift a plate of the multi-plate equipped apparatus.

The present invention provides a plate lifting device, which is applied to a multi-plate equipped apparatus, wherein the multi-plate equipped apparatus comprises a base and a plurality of plates disposed on the base. The plate lifting device includes a motor, a retractable shaft, a restriction member, and a lifting mechanism, wherein the motor is disposed on the base. The retractable shaft is pivotally disposed on the base, wherein an end of the retractable shaft is connected to the motor to be driven by the motor to extend or retract, and another end of the retractable shaft has a movable member. The restriction member is connected to one of the plates of the multi-plate equipped apparatus, wherein the restriction member has a slot to be passed through by the movable member. The lifting mechanism is disposed on the base, wherein when the motor drives the retractable shaft to extend from an initial state, the lifting mechanism is in contact with the movable member and lifts the movable member, so that the restriction member and the one of the plates connected to the restriction member, which are moved together with the movable member, are lifted.

In addition, the another primary objective of the present invention is to provide a lifting bed, which could be smoothly lifted under a horizontal state.

The present invention further provides a lifting bed, which includes a base, a plurality of plates, and a plate lifting device, wherein the plates are disposed on the base. The plate lifting device is disposed between the base and the plates, and includes a motor, a retractable shaft, a restriction member, and a lifting mechanism, wherein the motor is disposed on the base. The retractable shaft is pivotally disposed on the base, wherein an end of the retractable shaft is connected to the motor, whereby to be driven by the motor to extend or retract, and another end of the retractable shaft has a movable member. The restriction member is connected to one of the plates of the lifting bed, wherein the restriction member has a slot to be passed through by the movable member. The lifting mechanism is disposed on the base, wherein when the motor drives the retractable shaft to extend from an initial state, the lifting mechanism is in contact with the movable member and lifts the movable member, so that the restriction member and the one of the plates connected to the restriction member, which are moved together with the movable member, are lifted.

With the aforementioned design, the disclosure of the present invention could smoothly lift the plate when the lifting bed is under the horizontal state.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
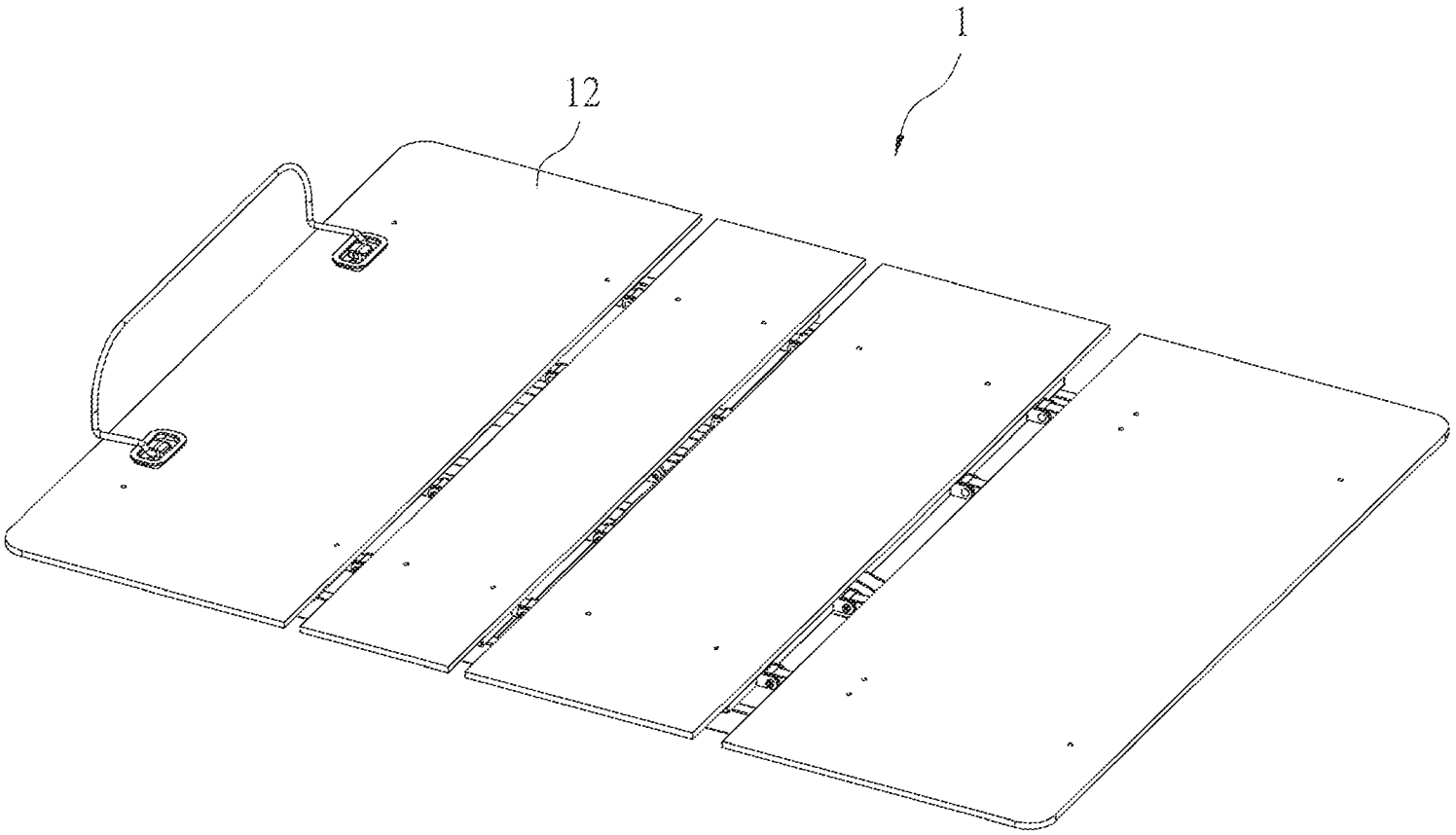
FIG. 1 is a schematic diagram of the lifting bed of an embodiment according to the present invention.
Figure 2:
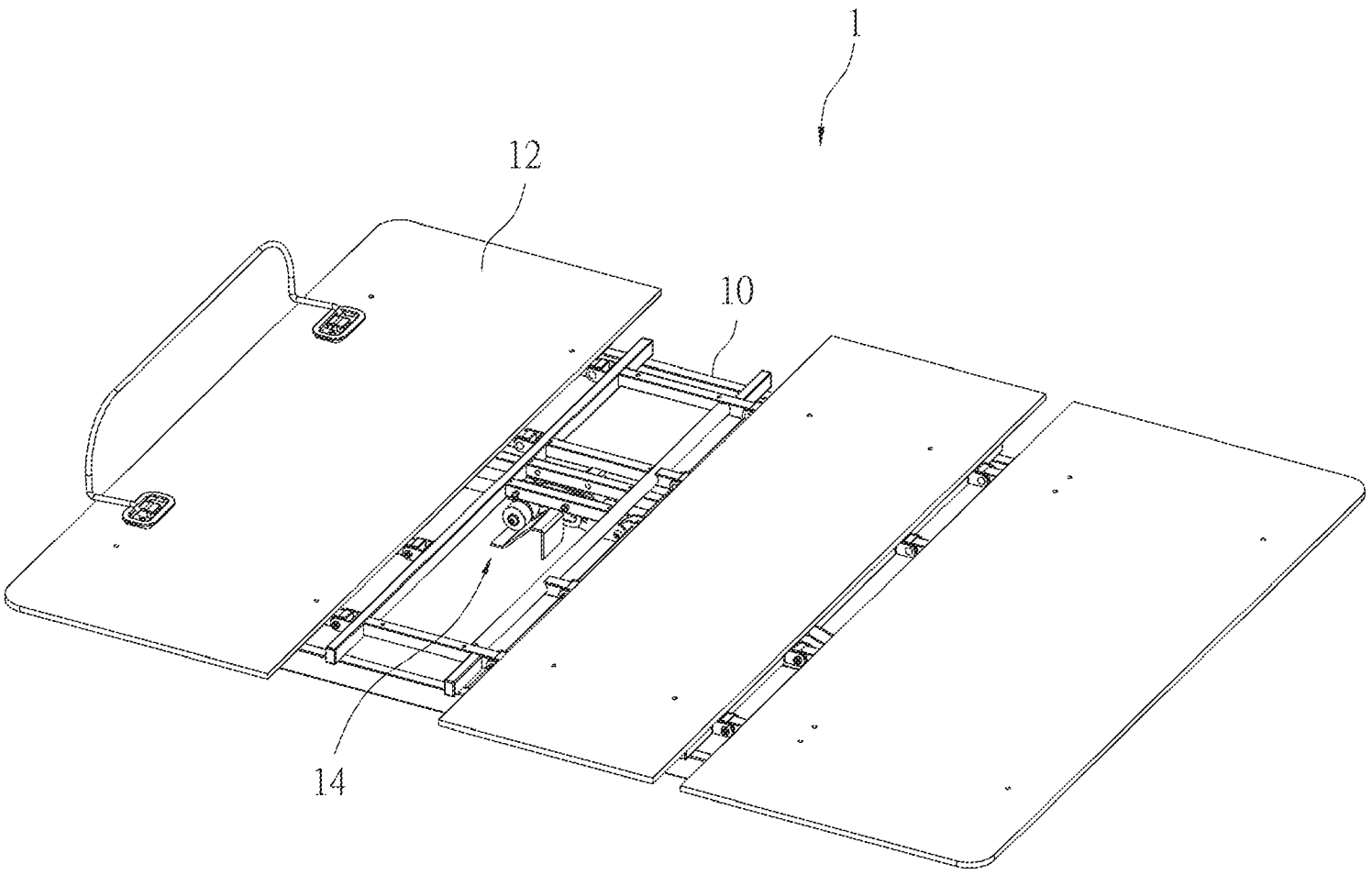
FIG. 2 is a partial schematic diagram of the lifting bed shown in FIG. 1 wherein a part of the plates shown in FIG. 1 is omitted.
Figure 3:
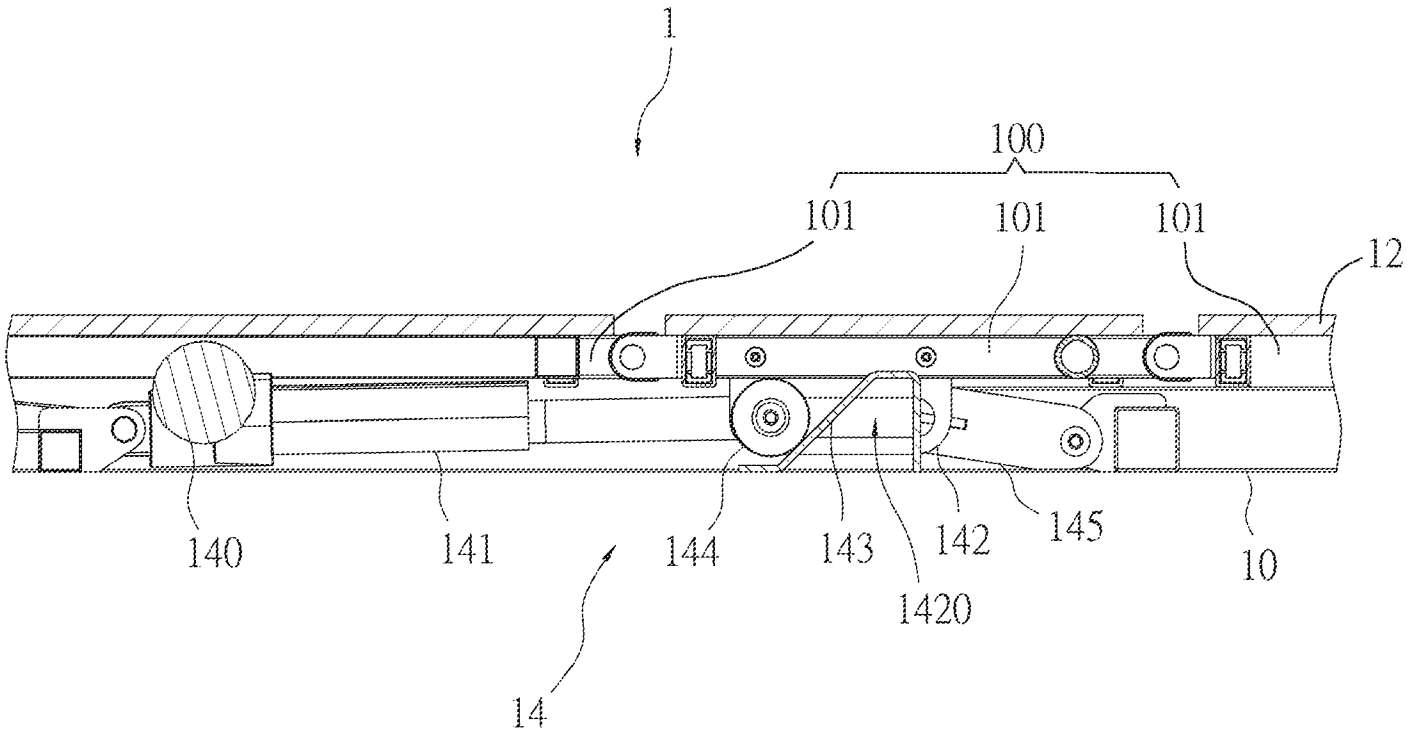
FIG. 3 is a partially sectional view of the lifting bed shown in FIG. 1.

FIG. 1 is a schematic diagram of a lifting bed 1 of an embodiment according to the present invention, FIG. 2 is a partial schematic diagram of the lifting bed 1 shown in FIG. 1, and FIG. 3 is a partially sectional view of the lifting bed shown in FIG. 1. As shown in FIG. 1 and FIG. 2, the lifting bed 1 includes a base 10, a plurality of plates 12, and a plate lifting device 14, wherein the plates 12 are disposed on the base 10, and the plate lifting device 14 is disposed between the base 10 and the plates 12. In FIG. 2, some of the plates 12 are omitted for brevity. It shall be noted that, the lifting bed 1 of the current embodiment is not limited to be an electric lifting bed for medical treatment or rehabilitation, but could be any multi-plate equipped apparatus with similar structure or function.

As shown in FIG. 3, the plate lifting device 14 has a motor 140, a retractable shaft 141, a restriction member 142, and a lifting mechanism 143, wherein the motor 140 and the lifting mechanism 143 are both disposed on the base 10, and an end of the retractable shaft 141 is pivotally connected to the base 10 and is connected to the motor 140. In practice, the motor 140 could be controlled by a controller in a wired or wireless manner to drive the retractable shaft 141 to extend or retract. Another end of the retractable shaft 141 has a movable member 144. The restriction member 142 is connected to one of the plates 12. More specifically, the base 10 has a movable frame assembly 100, wherein the movable frame assembly 100 includes a plurality of movable frames 101. Each of the plates 12 is disposed on one of the movable frames 101 of the movable frame assembly 100. The restriction member 142 is connected to one of the movable frames 101 which disposes with one of the plates 12. The restriction member 142 has a slot 1420, and the movable member 144 passes through the slot 1420. In addition, the plate lifting device 14 further has a driven member 145, wherein an end of the driven member 145 is pivotally connected to the base 10, and another end thereof is connected to the movable member 144. In practice, the driven member 145 could have a slot to be passed through by the movable member 144. The another end of the driven member 145, which is connected to the movable member 144, is connected to or abuts against the one of the movable frames 101 on which the restriction member 142 is disposed. In this way, when the motor 140 drives the retractable shaft 141 to extend or retract, the restriction member 142, the driven member 145, the movable frame assembly 100, and the plates 12 located on the movable frame assembly 100 could be operatively coupled to the retractable shaft 141 and the movable member 144.

Figure 4:
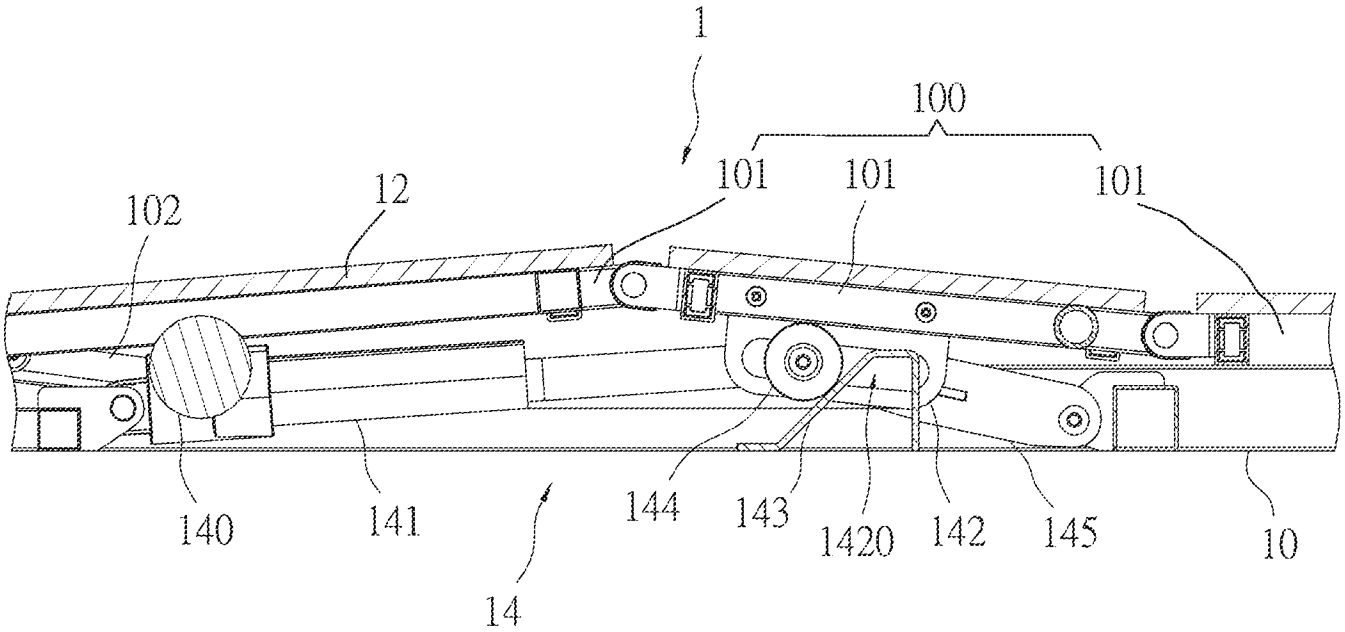
FIG. 4 is a partially sectional view of FIG. 3, showing the movable member is lifted by the lifting mechanism.
Figure 5:
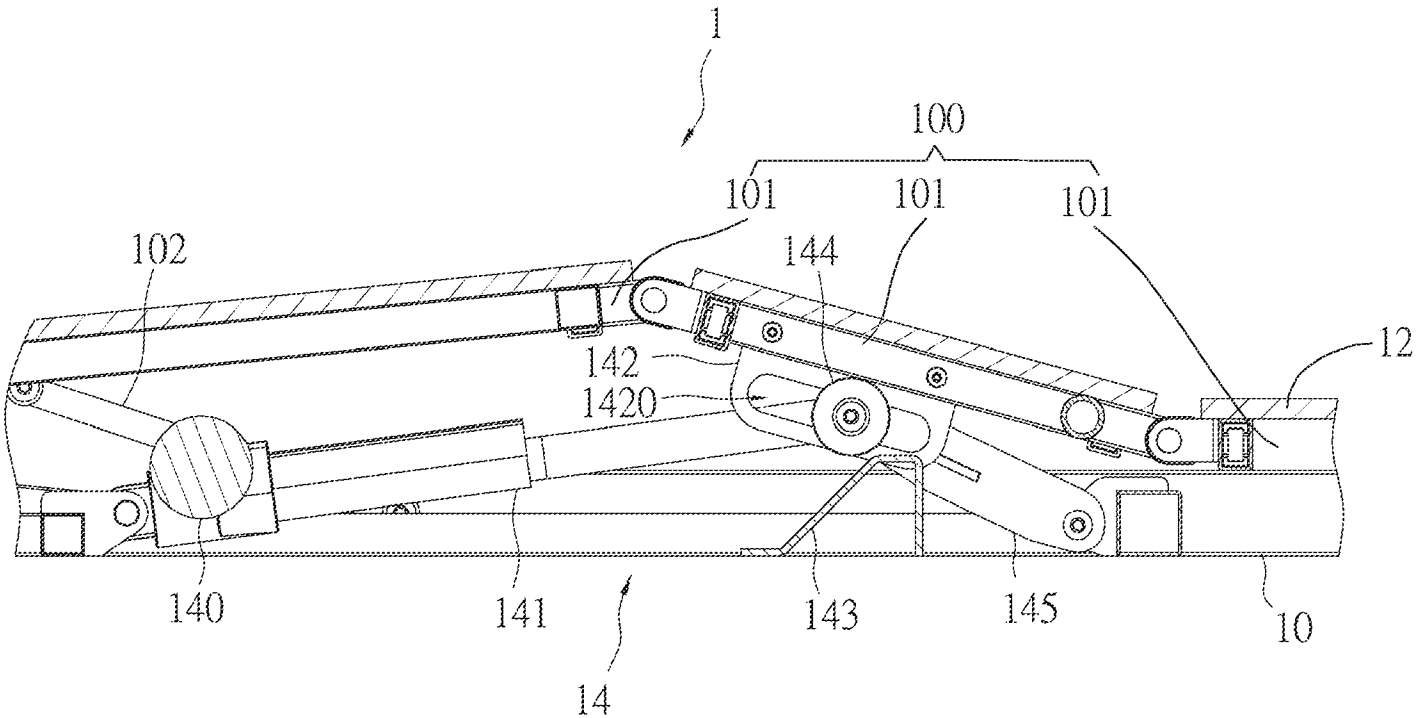
FIG. 5 is a partially sectional view of FIG. 3, showing the movable member is lifted by the lifting mechanism.

The lifting mechanism 143 is disposed on the base 10, and is located corresponding to the movable member 144. In an initial state, the retractable shaft 141 is not lifted. At this time, the plates 12 of the lifting bed 1 are in a horizontal state. When the plates 12 of the lifting bed 1 are in the horizontal state and the motor 140 is controlled to drive the retractable shaft 141 to extend, the movable member 144 is in contact with the lifting mechanism 143, and is lifted by the lifting mechanism 143. In the current embodiment, the movable member 144 is a roller, and the lifting mechanism 143 is a slope with an inclined plane. By rolling the roller on the inclined plane, a lifting result could be achieved. FIG. 4 and FIG. 5 are partially cross-sectional views of FIG. 3, showing the movable member 144 is lifted by the lifting mechanism 143. As shown in FIG. 3 to FIG. 5, when the motor 140 starts driving the retractable shaft 141 to extend, the roller is in contact with the inclined plane of the slope. Then, the motor 140 continues to push the retractable shaft 141 to extend so as to move the movable member 144 forward, and the movable member 144 (e.g. the roller) rolls on the inclined plane of the lifting mechanism 143 and moves upward. When the movable member 144 moves upward on the slope, the restriction member 142 and the driven member 145 which are moved together with the movable member 144 would be also lifted, whereby to move the movable frame assembly 100 and the plates 12 upward by abutting against the movable frame assembly 100 and the plates 12. In this way, even the plates 12 of the lifting bed 1 are in the horizontal state and once the motor 140 starts to drive the retractable shaft 141 to extend, a force exerted by the motor 140 is partially converted to a vertical component by the lifting mechanism 143, so that the plates 12 could be smoothly lifted.

In the current embodiment, one of the movable frames 101 has two ends, wherein one end of said movable frame 101 is pivotally connected to a supporting shaft 102 disposed on the base 10, and another end thereof is pivotally connected to an adjacent movable frame 101. The supporting shaft 102 is located below another one of the plates 12 (as shown in FIG. 4, the leftmost plate 12) which is adjacent to the plate 12 connected to the restriction member 142. In other words, the supporting shaft 102 is located opposite to the retractable shaft 141. As shown in FIG. 3 to FIG. 5, when the motor 140 drives the retractable shaft 141 to expand to lift the restriction member 142 and the driven member 145 at the same time, the movable frame 101 and the plate 12, which are located above the restriction member 142, could be abutted to lift at the same time. The movable frame 101 located above the restriction member 142 is pivotally connected to an adjacent movable frame 101 which is located above the supporting shaft 102. In this way, when the movable frame 101 located above the restriction member 142 is lifted, the adjacent movable frame 101 located above the supporting shaft 102 could be also lifted, and the supporting shaft 102 could be erected at the same time. The supporting shaft 102 could maintain the stability of the lifted movable frame assembly 100 and could support the movable frame assembly 100 and the plates 12.

Figure 6:
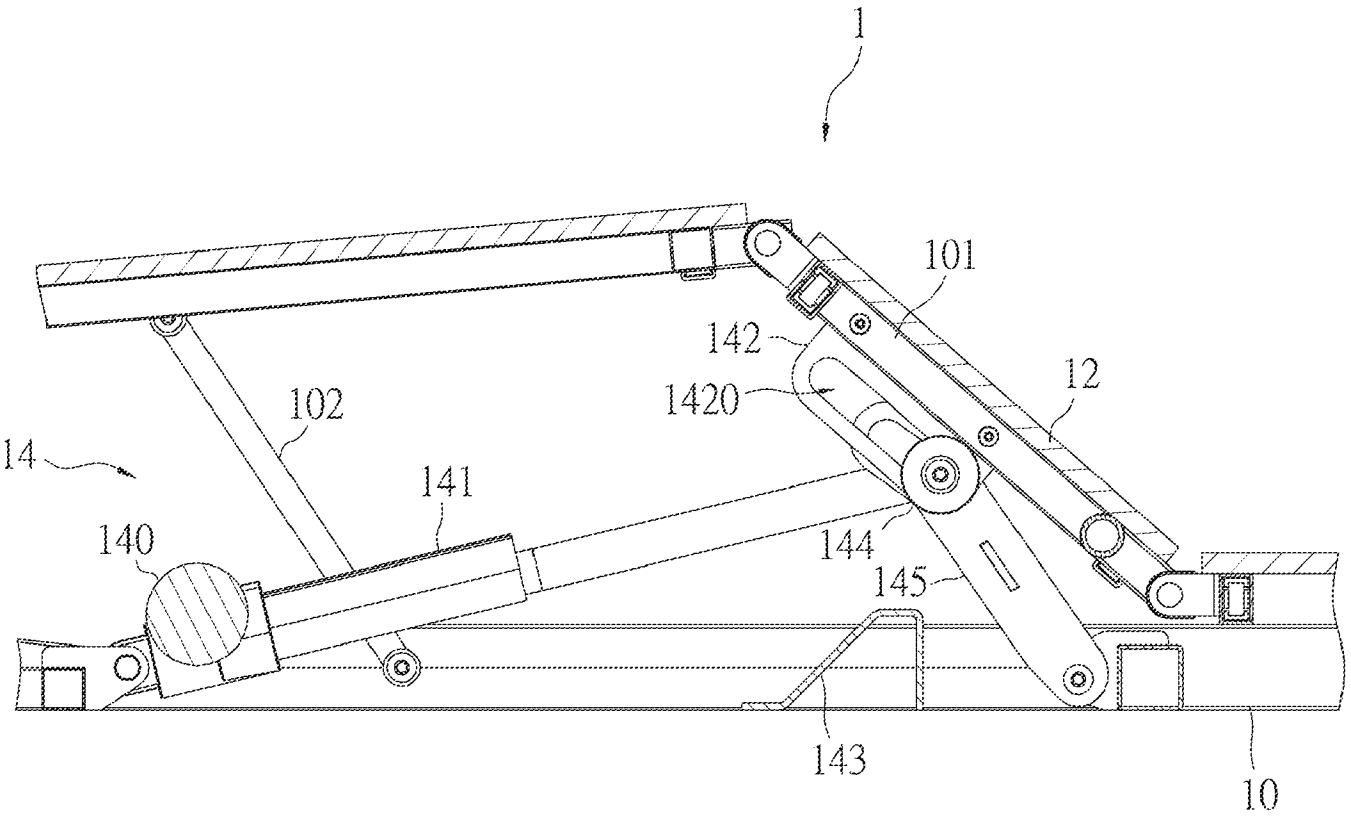
FIG. 6 is a partially sectional view of FIG. 3, showing the plate is lifted to a certain height by the plate lifting device.

As described above, when the plates 12 of the lifting bed 1 are in the horizontal state, the plates 12 could be lifted more smoothly with the guide of the lifting mechanism 143. In addition, when the plates 12 are lifted to a certain degree, the force applied on the retractable shaft 141 by the motor 140 would have a considerable degree of vertical component, so that the movable member 144 may not require the guidance of the lifting mechanism 143. FIG. 6 is a partially cross-sectional view of FIG. 3, showing the plates 12 are lifted to a certain height by the plate lifting device 14. As shown in FIG. 5 and FIG. 6, when the motor 140 drives the retractable shaft 141 to extend to move the movable member 144 to a highest point of the slope along the inclined plane of the lifting mechanism 143, a movement of the plates 12 would be converted from guide lifting mode to swing-arm lifting mode if the motor 140 continues to push the retractable shaft 141 since the force applied on the retractable shaft 141 by the motor 140 already has a considerable degree of vertical component.

Referring back to FIG. 2, only one roller and one slope are depicted in the drawing, however, in practice, the movable member 144 could include two rollers respectively disposed on two opposite surfaces on one end of the retractable shaft 141. Similarly, the lifting mechanism 143 could include two slopes respectively corresponding to the two rollers. In this way, when the motor 140 pushes the retractable shaft 141, the two rollers could roll on the inclined planes of the two slopes, which improves the stability of the lifting movement. However, the number of the roller and the number of the slope are not a limitation of the present invention, even if the movable member includes only one roller and the lifting mechanism only includes one slope, the performance of smoothly lifting the plates could still be achieved as well.

In addition, in the current embodiment, the lifting mechanism 143 is the slope with the inclined plane. However, the lifting mechanism is not limited to be a slope, but could be any structure capable of guiding the movable member during the lifting process.

Figure 7:
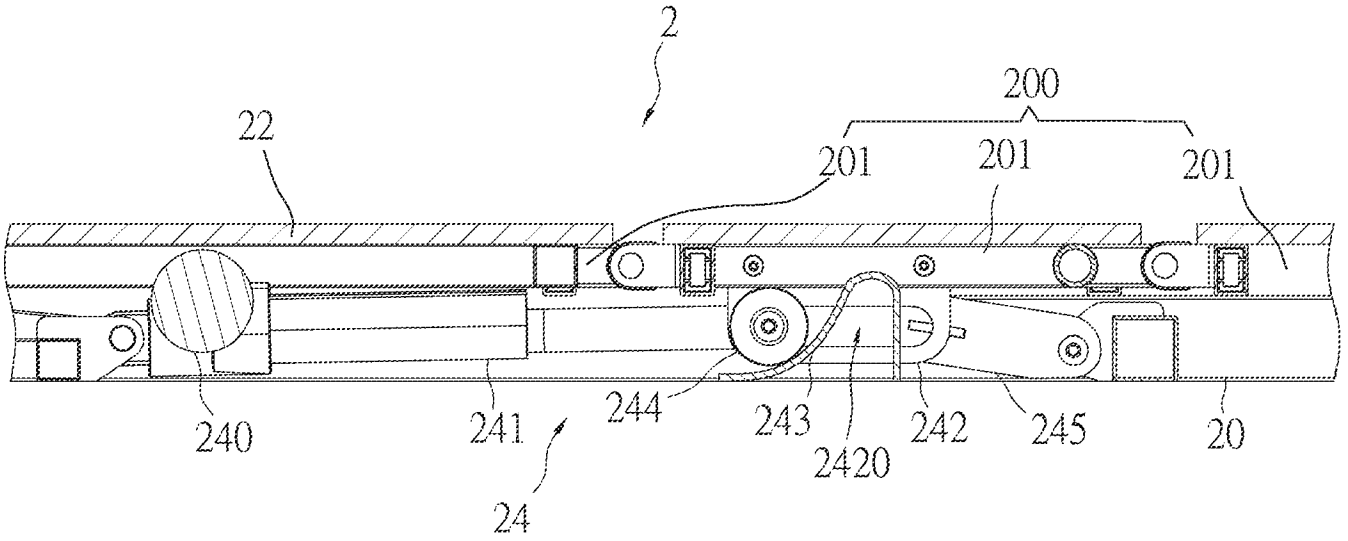
FIG. 7 is a partially sectional view of the lifting bed of another embodiment according to the present invention.
Figure 8:
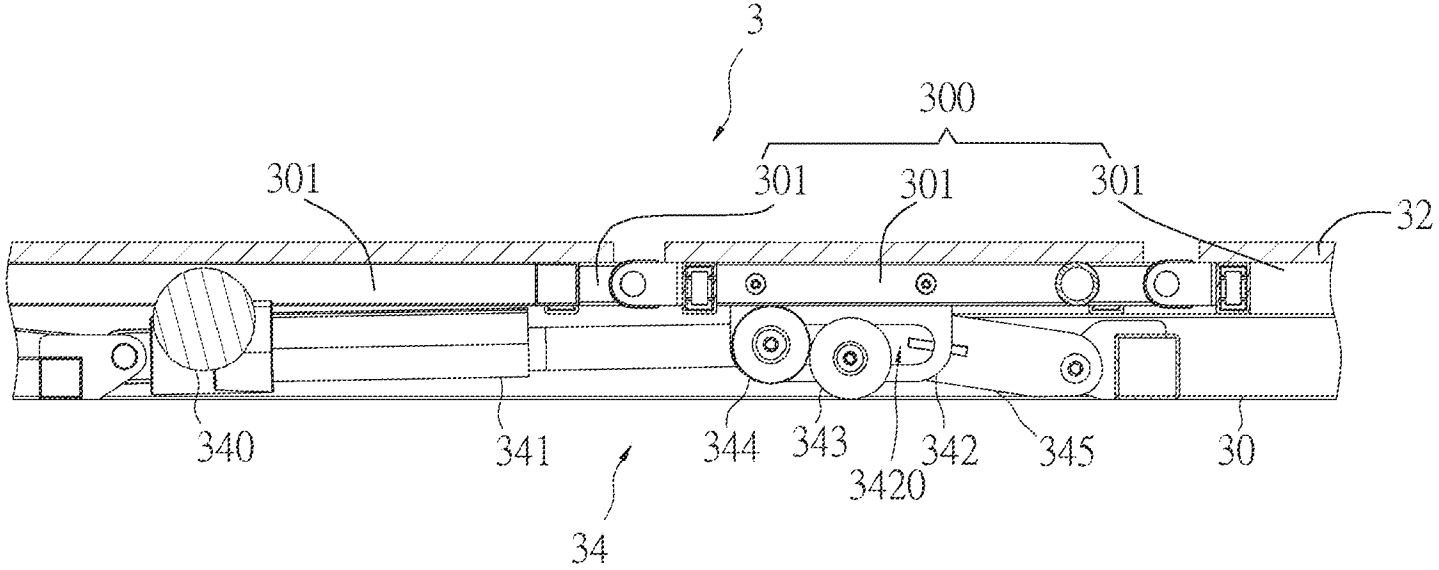
FIG. 8 is a partially sectional view of the lifting bed of still another embodiment according to the present invention.

FIG. 7 is a partially cross-sectional view of a lifting bed 2 of another embodiment according to the present invention, and FIG. 8 is a partially cross-sectional view of a lifting bed 3 of still another embodiment according to the present invention. As shown in FIG. 7, the lifting bed 2 has almost the same structure with the lifting bed 1 shown in FIG. 1, except that a lifting mechanism 243 of the lifting bed 2 according to the current embodiment is a slope with a curved surface. A movable member 244 could roll on the curved surface of the lifting mechanism 243. In this way, the movable member 244 could be also guided by the lifting mechanism 243. It shall be noted that, other structures are almost the same as or similar to that of the aforementioned embodiment, thus we are not going to describe in details herein.

As shown in FIG. 8, the lifting bed 3 has almost the same structure with the lifting bed 1 shown in FIG. 1, except that a lifting mechanism 343 of the lifting bed 3 according to the current embodiment includes a fixed roller. An axial core of the fixed roller of the lifting mechanism 343 is fixed on a base 30, and the fixed roller could rotate around the axial core. In an initial state, the retractable shaft 341 is lifted. When a motor 340 drives a retractable shaft 341 to extend from the initial state, a movable member 344 is in contact with and pushes a peripheral surface of the fixed roller, so that the fixed roller is rotated, and the movable member 344 moves upward along the peripheral surface of the fixed roller. In this way, the lifting process could be smoother. In the current embodiment, the movable member 344 is a roller, wherein a peripheral surface of the roller is in contact with the fixed roller to generate relative rotation. In other embodiments, the movable member 344 could be a fixed member, wherein during the lifting process, the fixed member is in contact with the fixed roller, so that the fixed member is lifted by the rotation of the fixed roller.

Figure 9:
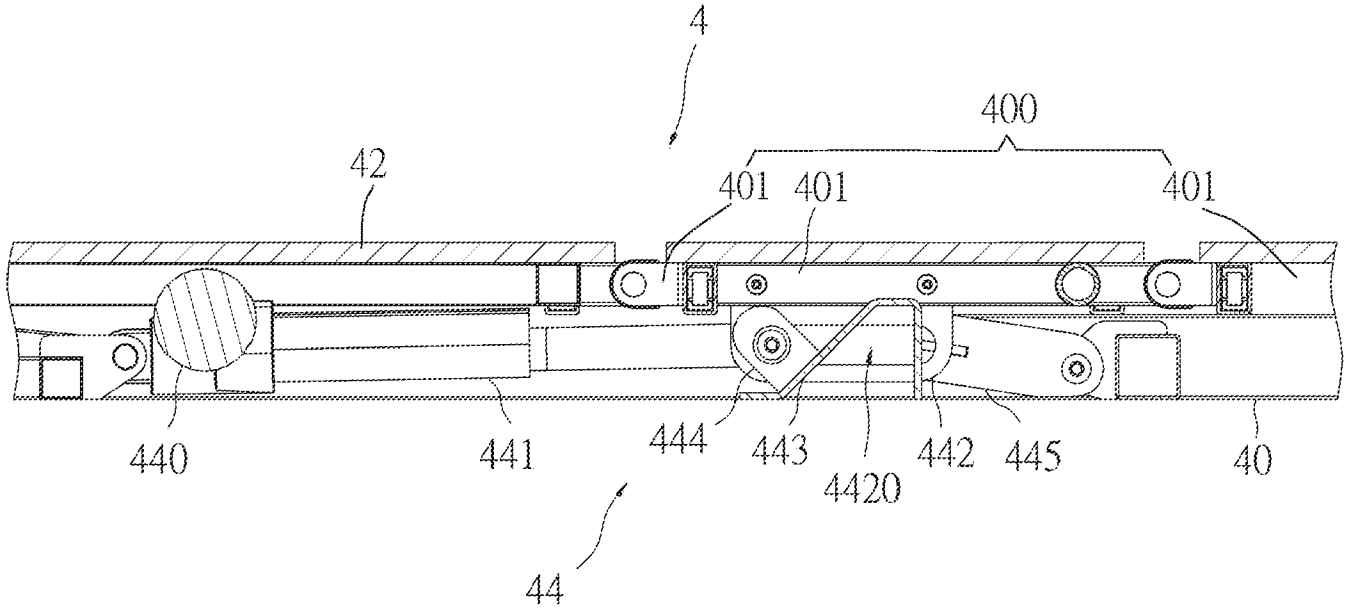
FIG. 9 is a partially sectional view of the lifting bed of still another embodiment according to the present invention.
Figure 10:
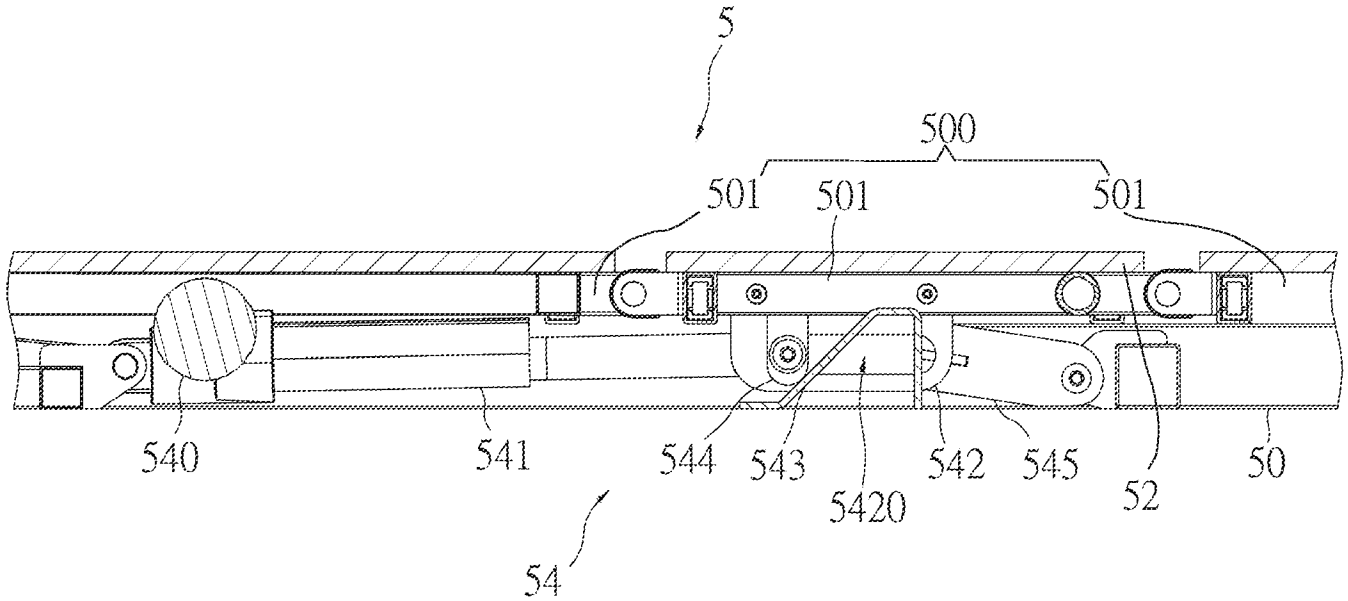
FIG. 10 is a partially sectional view of the lifting bed of still another embodiment according to the present invention.

In the aforementioned embodiments, the movable member is the roller capable of rolling on the inclined plane, the curved surface, or the peripheral surface of the lifting mechanism. However, the movement of the movable member is not limited by rolling. FIG. 9 is a partially cross-sectional view of a lifting bed 4 of still another embodiment according to the present invention, and FIG. 10 is a partially sectional view of a lifting bed 5 of still another embodiment according to the present invention. As shown in FIG. 9 and FIG. 10, movable members 444, 544 are both sliding members and the retractable shafts 441, 541 are not lifted in an initial state. When motors 440, 540 push the retractable shafts 441, 541 from the initial state, the movable members 444, 544 are respectively in contact with inclined planes of lifting mechanisms 443, 543. In this way, plates 42, 52 could be lifted by sliding the sliding members upward along the inclined planes. It is noted that, other structures of the lifting beds 4, 5 shown in FIG. 9 and FIG. 10 are almost the same as or similar to that of the aforementioned embodiments, thus we are not going to describe in details herein.

The plate lifting device of each of the aforementioned embodiments is applied to the lifting bed. However, the application of the plate lifting device is not a limitation of the present invention. In practice, the plate lifting device of the present invention could be applied to any multi-plate equipped apparatus having a plurality of plates, whereby to smoothly lift the plates from a horizontal state.

It could be known from the aforementioned embodiments, by utilizing the movable member, which is located on the retractable shaft, in conjunction with the lifting mechanism, the plate lifting device of the present invention could smoothly lift the plates of the multi-plate equipped apparatus such as a lifting bed from a horizontal state, and could prevent the components of the multi-plate equipped apparatus from being damaged due to push each other during the lifting process.

It must be pointed out that the embodiments described above are only some preferred embodiments of the present invention. All equivalent structures which employ the concepts disclosed in this specification and the appended claims should fall within the scope of the present invention.

What is claimed is:

1. A plate lifting device, which is applied to a multi-plate equipped apparatus, wherein the multi-plate equipped apparatus comprises a base and a plurality of plates disposed on the base; the plate lifting device comprising:

a motor disposed on the base;

a retractable shaft which is pivotally disposed on the base, wherein an end of the retractable shaft is connected to the motor to be driven by the motor to extend or retract, and another end of the retractable shaft has a movable member;

a restriction member which is connected to one of the plates of the multi-plate equipped apparatus, wherein the restriction member has a slot to be passed through by the movable member;

a lifting mechanism which is disposed on the base, wherein when the motor drives the retractable shaft to extend from an initial state, the lifting mechanism is in contact with the movable member and lifts the movable member, so that the restriction member and the one of the plates connected to the restriction member, which are moved together with the movable member, are lifted;

a driven member, wherein an end of the driven member is pivotally connected to the base, and another end of the driven member is connected to the movable member;

wherein the motor, the retractable shaft, the movable member, the restriction member, and the driven member are operatively coupled in sequence; and wherein the lifting mechanism is located between a position where the driven member is pivotally connected to the base and a position where the retractable shaft is pivotally connected to the base.

2. The plate lifting device of claim 1, wherein the lifting mechanism comprises a slope; the slope has an inclined plane facing toward the retractable shaft; when the motor drives the retractable shaft to extend from the initial state, the movable member moves upward along the inclined plane, and is lifted by the inclined plane.

3. The plate lifting device of claim 1, wherein the lifting mechanism comprises a fixed roller, which is rotatably disposed on the base; when the motor drives the retractable shaft to extend from the initial state, the movable member pushes the fixed roller to rotate, and is lifted by a rotation of the fixed roller.

4. The plate lifting device of claim 1, wherein the movable member comprises a roller; when the motor drives the retractable shaft to extend from the initial state, the roller rolls upward on the lifting mechanism.

5. The plate lifting device of claim 1, wherein the movable member comprises a sliding member; when the motor drives the retractable shaft to extend from the initial state, the sliding member slides upward on the lifting mechanism.

6. A lifting bed, comprising:

a base;

a plurality of plates disposed on the base; and a plate lifting device which is disposed between the base and the plates, wherein the plate lifting device comprises:

a motor disposed on the base;

a retractable shaft which is pivotally disposed on the base, wherein an end of the retractable shaft is connected to the motor, whereby to be driven by the motor to extend or retract, and another end of the retractable shaft has a movable member;

a restriction member which is connected to one of the plates of the lifting bed, wherein the restriction member has a slot to be passed through by the movable member;

a lifting mechanism which is disposed on the base, wherein when the motor drives the retractable shaft to extend from an initial state, the lifting mechanism is in contact with the movable member and lifts the movable member, so that the restriction member and the one of the plates connected to the restriction member, which are moved together with the movable member, are lifted;

a driven member, wherein an end of the driven member is pivotally connected to the base, and another end of the driven member is connected to the movable member; and wherein the motor, the retractable shaft, the movable member, the restriction member, and the driven member are operatively coupled in sequence; and wherein the lifting mechanism is located between a position where the driven member is pivotally connected to the base and a position where the retractable shaft is pivotally connected to the base.

7. The lifting bed of claim 6, wherein the lifting mechanism comprises a slope; the slope has an inclined plane facing toward the retractable shaft; when the motor drives the retractable shaft to extend from the initial state, the movable member moves upward along the inclined plane, and is lifted by the inclined plane.

8. The lifting bed of claim 6, wherein the lifting mechanism comprises a fixed roller, which is rotatably disposed on the base; when the motor drives the retractable shaft to extend from the initial state, the movable member pushes the fixed roller to rotate, and is lifted by a rotation of the fixed roller.

9. The lifting bed of claim 6, wherein the movable member comprises a roller; when the motor drives the retractable shaft to extend from the initial state, the roller rolls upward on the lifting mechanism.

10. The lifting bed of claim 6, wherein the movable member comprises a sliding member; when the motor drives the retractable shaft to extend from the initial state, the sliding member slides upward on the lifting mechanism.

* * * * *